United States Patent [19]

Handman

[11] 4,244,478

[45] Jan. 13, 1981

[54] CLOSURE ASSEMBLY FOR UNIT DOSE VIAL

[75] Inventor: Richard Handman, Atlanta, Ga.

[73] Assignee: MPL, Inc., Chicago, Ill.

[21] Appl. No.: 52,562

[22] Filed: Jun. 27, 1979

[51] Int. Cl.[3] ..... B65D 51/16; B65D 51/18

[52] U.S. Cl. ..... 215/249; 215/251; 215/254; 215/311; 215/DIG. 3

[58] Field of Search ..... 215/251, 248, 249, 307, 215/311, 247, 310, DIG. 3, 253, 254; 220/307, 319, 257

[56] References Cited

U.S. PATENT DOCUMENTS

| | | | |
|---|---|---|---|
| 1,180,665 | 4/1916 | McElroy | 215/247 X |
| 1,865,764 | 7/1932 | Keenan | 215/DIG. 3 |
| 2,236,491 | 3/1941 | Campbell | 215/249 |
| 2,436,291 | 2/1948 | Daniel | 215/247 |
| 2,465,269 | 3/1949 | Rohde et al. | 215/249 |
| 2,579,724 | 12/1951 | Breakstone | 215/311 X |
| 2,797,837 | 7/1957 | Roberts | 215/311 |
| 3,067,898 | 12/1962 | Reimann | 215/249 |
| 3,067,898 | 12/1962 | Reimann | 215/249 |
| 3,208,627 | 9/1965 | Lipske | 220/257 X |
| 3,310,193 | 3/1967 | MacPherson | 215/311 X |
| 3,653,528 | 4/1972 | Wimmer | 215/247 |
| 3,786,983 | 1/1974 | Hennessey | 206/628 X |
| 4,111,330 | 9/1978 | Jordan | 220/319 |
| 4,181,232 | 1/1980 | Bellamy et al. | 215/232 |

FOREIGN PATENT DOCUMENTS

| | | | |
|---|---|---|---|
| 2217325 | 2/1973 | Fed. Rep. of Germany | 215/310 |
| 602763 | 6/1948 | United Kingdom | 215/247 |

*Primary Examiner*—Allan N. Shoap
*Attorney, Agent, or Firm*—Kinzer, Plyer, Dorn & McEachran

[57] ABSTRACT

A closure for a unit dose vial for oral administration of medication, comprising an elastomer stopper which seals the vial and affords a rim covering the lip of the vial, and a metal sealing ring crimped onto the vial, covering the stopper rim but exposing a self-venting self-sealing linear slit valve in the stopper, the sealing ring including an integral release tab allowing quick, convenient removal of both the ring and the stopper for oral administration of the vial contents.

2 Claims, 6 Drawing Figures

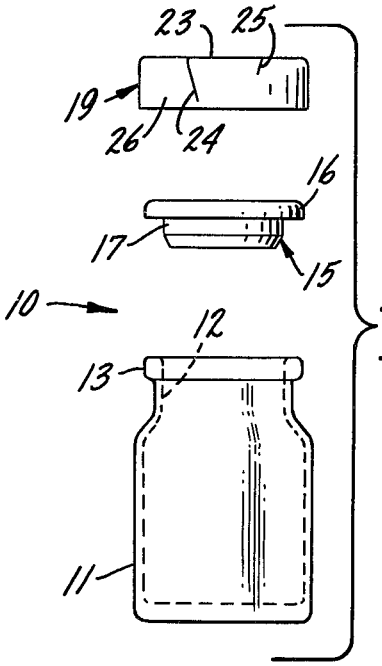
Fig. 1.
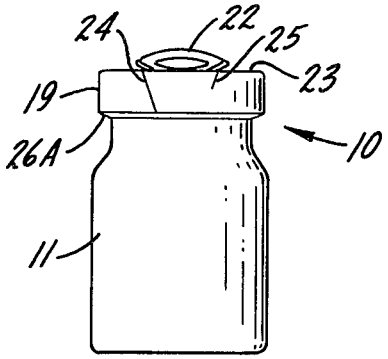
Fig. 2.
Fig. 3.
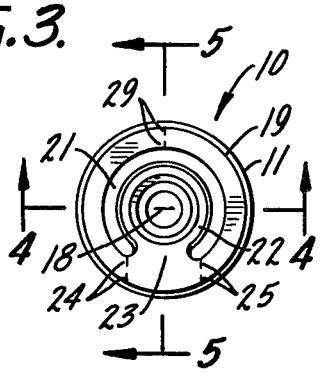
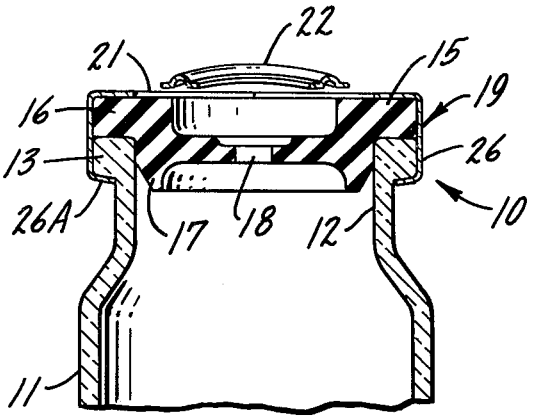
Fig. 4.
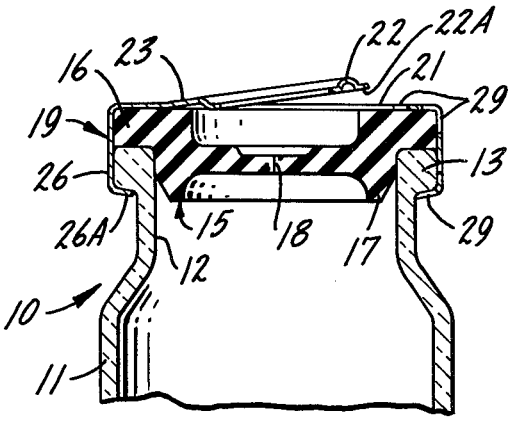
Fig. 5.
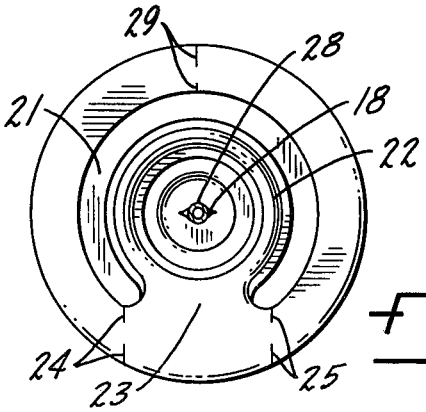
Fig. 6.

CLOSURE ASSEMBLY FOR UNIT DOSE VIAL

BACKGROUND OF THE INVENTION

In hospitals, clinics, and other health care facilities, a wide variety of medications are administered to the patients; many of these medications are administered orally. Oral administration generally requires that a dose of medication be deposited in a vial or other small container in the pharmacy of the health care facility, from which it is transported to the patient and ultimately administered. This procedure provides many opportunities for contamination or spillage, particularly because efficient operation of the pharmacy makes it desirable to pre-fill a number of vials of a given medication at one time, though use may be spread out over an entire day or even several days. If the vials are sealed at the time of filling, the patient or the nurse may experience difficulty in opening a vial at the time of administration, depending upon the type and construction of seal employed. Contamination at the time of filling is also a persistent problem.

A number of different constructions for sealed vials, primarily intended for multi-dose use as in the filling of syringes, are known in the art. One example of a closure construction for a multi-dose vial or the like is shown in Gould U.S. Pat. No. 3,013,687, issued Dec. 19, 1961. The Gould closure provides an elastomer stopper that is held in place by an apertured metal retaining ring which is in turn covered by a metal cap, with both the metal retaining ring and the cap being crimped over the lip of the vial. The outer cap is readily removed by means of a release tab, allowing the withdrawal of individual doses from the vial by a needle that punctures the elastomer stopper.

Another previously known closure structure for a multi-dose vial or like container is shown in Hershberg et al U.S. Pat. No. 3,424,329, issued Jan. 28, 1969. That closure construction employs a resin disc and a superimposed elastomer disc closing off the opening to the vial; a resin sealing ring engages the periphery of the elastomer disc and extends downwardly to encompass the lip of the vial, with the entire closure assembly being held in place by a metal sealing ring crimped to the vial and having a central opening allowing access to the elastomer disc. In use, the contents of the vial are removed, in individual doses, by inserting a needle through the two closure discs and into the interior of the vial.

Another construction for a multi-dose sealed vial, which minimizes the possibility of contamination due to puncturing of the elastomer seal member, is shown in Zackheim U.S. Pat. No. 3,823,840 issued July 16, 1974. This closure employs an elastomer disc covering the neck of the vial and in turn covered by a metal film; a metal cap crimped to the neck of the vial covers the metal film and holds the assembly together. The central portion of the cap incorporates a tear tab that can be removed, followed by removal of the metal film to expose a semi-circular slit valve in the elastomer closure member through which individual doses of medication can be withdrawn.

Unit dose disposable syringes are also known in the art, an excellent example being Baldwin U.S. Pat. No. 3,729,031 issued Apr. 24, 1973. That device employs an elastomer plunger having a slit valve that permits filling of the syringe from the rear, the plunger valve re-sealing itself for future use in discharging medication from the syringe.

For a vial intended for oral administration of medication, the closure should permit filling the vial while in clean and sterile condition without removing or altering any part of the closure and without requiring puncturing of any closure element. At the same time, the closure assembly for a unit dose vial for oral administration should permit rapid and convenient removal of the entire closure by either a nurse or a patient at the time of administration. In addition, the closure assembly ought to be simple and inexpensive and should maintain sterile conditions at all times. These sometimes conflicting requirements are not effectively met in the prior art devices.

SUMMARY OF THE INVENTION

It is an object of the present invention, therefore, to provide a new and improved closure assembly for a unit dose vial intended for oral administration of medication which permits rapid filling of the vial, with the closure in place and vial and closure in sterile condition, without removing any part of the closure assembly and without requiring puncturing of any element of the closure assembly.

Another object of the invention is to provide a new and improved vial closure assembly for a unit dose oral administration vial that allows for rapid and convenient removal of the entire closure assembly by a nurse or a patient at the time of administration, although affording effective protection against contamination or spillage for an indefinite period prior to administration.

A specific object of the invention is to provide a new and improved closure assembly for a unit dose vial for oral administration of medication that is simple and inexpensive in construction even though it permits filling of the vial with the closure in place, seals the vial automatically after filling, and allows immediate removal of the entire closure assembly in a convenient manner.

Accordingly, the invention is directed to a unit dose vial closure assembly for oral administration of medication, for use with a vial having an outlet opening and an annular lip around the outlet opening, the closure assembly comprising an elastomer stopper fitted into and sealing the outlet opening of the vial, the stopper including an annular rim at least partially covering the lip of the vial and a self-venting, self-resealing linear slit valve permitting the deposit of medication into the vial with the stopper in sealing position in the outlet opening of the vial and without requiring puncture of the stopper. A metal sealing ring is crimped onto the annular lip of the vial, the sealing ring covering the rim of the stopper to preclude contamination from outside sources; the sealing ring has a central opening affording direct access to the slit valve in the stopper without requiring removal or alteration of the sealing ring. The sealing ring further includes an integral release tab which, when pulled from the sealing ring, releases the sealing ring to allow ready removal of the sealing ring and the stopper for oral administration of the contents of the vial.

BRIEF DESCRIPTION OF THE DRAWINGS

FIG. 1 is an exploded elevation view of a vial and closure assembly for a unit dose vial for oral administration of medication, the closure assembly being constructed in accordance with a preferred embodiment of the present invention;

FIG. 2 is an elevation view of the closure assembly of FIG. 1 in assembled condition on the vial;

FIG. 3 is a plan view of the closure assembly;

FIG. 4 is a sectional elevation view, on an enlarged scale, taken approximately along line 4—4 in FIG. 3;

FIG. 5 is a sectional elevation view, like FIG. 4 but taken approximately along line 5—5 in FIG. 3; and FIG. 6 is a detail plan view, partly in cross section, illustrating filling of the vial.

DESCRIPTION OF THE PREFERRED EMBODIMENT

FIGS. 1–3 illustrate a closure assembly 10 for a unit dose vial 11 intended for oral administration of medication in a hospital, clinic, or other health care facility. The vial 11 is of conventional construction, having an outlet opening 12 with an annular lip 13 around the outlet opening. The size of the vial is not critical; fifteen, thirty, and sixty milliliter sizes are common. The vial 11 is customarily formed of glass, often amber glass.

The closure assembly 10 comprises an elastomer stopper 15 including an annular rim portion 16 that covers the upper surface of the vial lip 13 when the stopper is inserted in the vial. Stopper 15 includes a depending portion 17 that preferably fits into the vial opening 12 firmly enough to seal the vial and to maintain the stopper in place covering the outlet of the vial. On the other hand, stopper 15 should not fit into the vial outlet opening 12 so tightly as to make it difficult to remove the stopper at the time of medication administration as described below. As shown in FIG. 3, stopper 15 has a self-venting self-resealing linear slit valve 18 at its center.

Closure assembly 10 further comprises a metal sealing ring 19, preferably formed of aluminum. Sealing ring 19 includes a large central opening 21 encompassing an annular release tab 22 attached to the peripheral portion of the ring by a bridge portion 23. Partial slit lines 24 and 25 are provided in sealing ring 19 at the sides of the bridge portion 23, the slit line 24 extending further down the skirt 26 of the sealing ring than line 25 as shown in FIGS. 1 and 2.

Starting with the vial 11 and the separate closure components 15 and 19 in separated condition, as shown in FIG. 1, the elements of the unit dose vial assembly are cleaned and sterilized. Stopper 15 is then inserted into the outlet opening 12 of vial 11 and the metal sealing ring 19 is placed over the stopper. The lower edge of the skirt 26 of sealing ring 19 is then crimped to the underside of the lip 23 as best shown in FIGS. 4 and 5. The crimped portion 26A of sealing ring 19 thus holds the stopper assembly 10 firmly in place on the neck of vial 11. Sealing ring 19 effectively covers the juncture between stopper 15 and the vial lip 13, precluding entry of any contaminating material at that point. Once assembled, the vial is ready for use, but that use can be deferred for a substantial period because the interior of the vial is effectively sealed.

When the assembled vial and closure is to be put to use, a relatively large blunt fill needle 28 is inserted in slit valve 18, producing the configuration shown in FIG. 6, with portions of the slit valve open at each side of the fill needle 28. This permits rapid deposit of medication into the vial 11, since the interior of the vial is effectively vented as long as the fill needle 28 remains in place. As soon as the fill needle 28 is removed, however, slit valve 18 closes to reseal the vial. Thus, even though the filled vial may not be put to use for some time, the contents of the vial remain protected at all times. Accordingly, the pharmacy of a health care facility such as a hospital can fill a large number of the vials with a given medication and can store those vials for substantial periods of time pending the need for their use. After filling, a paper security seal (not shown) may be applied over the top of the vial if desired, as for narcotics and other closely controlled drugs, but is not necessary for maintenance of sterility.

When the contents of a vial is to be administered to a patient, transportation to the patient presents no problem because the vial remains thoroughly sealed at all times; there is no problem of contamination or spillage. For administration, the release tab 22 is pulled upwardly, breaking loose initially along the longest slit lines 24. A continued outward pull on the tab, away from the rim of the vial, causes the metal ring 19 to bend outwardly at an additional release slit 29 on the opposite side of the ring (FIGS. 3 and 5). Thus, in a single movement the sealing ring 19 is removed from the vial, with only minimum effort on the part of a nurse or a patient. It is then a simple matter to remove stopper 15, allowing immediate oral administration of the contents of vial 11 to the patient. Opportunities for contamination or spillage are effectively minimized and, for the most part, eliminated; nevertheless, both the filling of the vial and administration of the contents of the vial are made simple, convenient, and highly effective. Cost of closure assembly 10 is minimal, since it requires only the one-piece metal sealing ring 19 and the simple molded stopper 15. With the illustrated construction, in which the rim portions 22A of the release tab 22 are formed to lie slightly below the outer top portion of ring 19, the mounting of ring 19 on vial 11 deflects the tab 22 slightly upwardly (FIGS. 2, 4 and 5), facilitating removal of ring 19 at the time of use.

I claim:

1. A unit dose vial closure assembly for oral administration of medication, for use with a vial having an outlet opening and an annular lip around the outlet opening and with a relatively large blunt fill needle, the closure assembly comprising:

an elastomer stopper fitted into and sealing the outlet opening of the vial, the stopper including an annular rim at least partially covering the lip of the vial and a self-venting, self-resealing linear slit valve permitting the deposit of medication into the vial, by insertion of the fill needle into the slit valve, with the stopper in sealing position in the outlet opening of the vial and without requiring puncture of the stopper;

and a metal sealing ring crimped onto the annular lip of the vial, the sealing ring covering the rim of the stopper to preclude contamination from outside sources, the sealing ring having a central opening affording direct access of the fill needle to the slit valve in the stopper without requiring removal or alteration of the sealing ring;

and the sealing ring including manual release means comprising a release tab formed integrally with the sealing ring and at least one partial slit line formed in the sealing ring immediately adjacent the release tab, so that a manual pull on the release tab breaks the sealing ring along the partial slit line and releases the sealing ring to allow ready removal of both the sealing ring and the stopper for oral administration of the contents of the vial, the release tab being located in the central opening of the metal sealing ring over the slit valve and being of annular configuration, the tab having an opening therethrough affording access to the slit valve through the tab for filling of the vile by the fill needle.

2. A unit dose vial closure assembly for oral administration of medication, according to claim 1, in which the release means further comprises an additional partial slit line in the sealing ring, approximately diametrically opposite to the release tab, the sealing ring bending outwardly about the additional partial slit line, on pulling of the release tab, to facilitate removal of the closure from the vial.

* * * * *